US012291871B2

(12) United States Patent
Ouyang

(10) Patent No.: US 12,291,871 B2
(45) Date of Patent: May 6, 2025

(54) INJECTION-MOLDED ROOF PANEL WITH IMPROVEMENTS

(71) Applicant: Feng Ouyang, Mississauga (CA)

(72) Inventor: Feng Ouyang, Mississauga (CA)

( * ) Notice: Subject to any disclaimer, the term of this patent is extended or adjusted under 35 U.S.C. 154(b) by 289 days.

(21) Appl. No.: 17/676,176

(22) Filed: Feb. 20, 2022

(65) Prior Publication Data

US 2023/0265659 A1 Aug. 24, 2023

(51) Int. Cl.

| | |
|---|---|
| ***E04D 1/00*** | (2006.01) |
| ***E04D 1/08*** | (2006.01) |
| ***E04D 1/26*** | (2006.01) |
| ***E04D 1/34*** | (2006.01) |

(52) U.S. Cl.

CPC ..... *E04D 1/2918* (2019.08); *E04D 1/08* (2013.01); *E04D 1/265* (2013.01); *E04D 1/2916* (2019.08); *E04D 1/2949* (2019.08); *E04D 1/2956* (2019.08); *E04D 1/34* (2013.01); *E04D 2001/3423* (2013.01); *E04D 2001/3426* (2013.01); *E04D 2001/3447* (2013.01); *E04D 2001/3458* (2013.01); *E04D 2001/3467* (2013.01); *E04D 2001/3497* (2013.01)

(58) Field of Classification Search

CPC ..... E04D 1/08; E04D 1/265; E04D 1/2916; E04D 1/2918; E04D 1/2949; E04D 1/2956; E04D 1/34; E04D 2001/3423; E04D 2001/3426; E04D 2001/3447; E04D 2001/3458; E04D 2001/3467; E04D 2001/3497

USPC ..... 52/520

See application file for complete search history.

(56) References Cited

U.S. PATENT DOCUMENTS

| | | | | |
|---|---|---|---|---|
| 592,474 A * | 10/1897 | Merrill | E04D 1/2916 | 52/553 |
| 885,663 A * | 4/1908 | Bruzaud | E04D 1/2918 | 52/538 |
| 1,125,414 A * | 1/1915 | Vogan | E04D 3/363 | 52/522 |

(Continued)

FOREIGN PATENT DOCUMENTS

| | | |
|---|---|---|
| CN | 208518218 U * | 2/2019 |
| DE | 3030819 A1 * | 2/1982 |

(Continued)

*Primary Examiner* — James M Ference

(57) ABSTRACT

The present disclosure provides a new design for an injection molded roof panel with multiple improvements. The panel is made from PVC-like materials via injection molding with a large standard size. It comprises laterally and longitudinally sloped watercourses and arches. A tongue at the front connects to a vertically adjacent panel's rear upper interlocking member. Interlocks at the lateral ends of the panel connect one panel to another horizontally adjacent panel. Condensed water ridges underneath the panel drain condensation to the panel's front, where it is drained with angled weep holes on the tongue. The upper surface has a non-smooth low-noise texture to prevent slips/falls and reduce noise. The roof panel is secured onto roof sheathing with nail flanges with screw holes/bosses. The design achieves improved water drainage, increased installation security and speed, improved wind resistance, increased personnel safety, reduced noise, lighter weight, lower cost, and improved lifespan.

20 Claims, 5 Drawing Sheets

(56) References Cited

U.S. PATENT DOCUMENTS 1,427,968 A * 9/1922 Pedersen ..... E04D 1/04 52/550
1,516,696 A * 11/1924 Bacot ..... E04D 1/2918 52/537
1,968,451 A * 7/1934 Hering ..... E04D 1/34 52/550
1,999,244 A * 4/1935 Ludowici ..... E04D 1/2916 D25/140
2,002,244 A * 5/1935 Kremper ..... E04D 1/2949 52/538
2,766,706 A * 10/1956 Ludowici ..... E04D 1/2949 52/533
3,629,988 A * 12/1971 Zylstra ..... E04D 3/30 52/537
3,852,934 A * 12/1974 Kirkhuff ..... E04D 1/30 52/555
3,862,532 A * 1/1975 Markos ..... E04D 3/32 52/553
3,977,141 A * 8/1976 Peters ..... E04D 1/265 52/534
3,983,675 A * 10/1976 Pearse ..... E04D 3/362 52/522
4,189,889 A * 2/1980 Yanoh ..... E04D 1/2949 52/553
4,372,090 A * 2/1983 Shichijo ..... E04D 1/04 428/167
4,432,183 A * 2/1984 Pike ..... E04D 1/2916 D25/140
4,574,536 A * 3/1986 Bamber ..... E04D 1/16 206/322
4,617,773 A * 10/1986 Studwell ..... E04D 3/30 52/537
4,754,589 A * 7/1988 Leth ..... B28B 19/00 52/538
4,890,432 A * 1/1990 Shepherd ..... E04D 1/2916 52/542
4,914,885 A * 4/1990 Baker ..... E04D 1/2916 52/549
4,932,184 A * 6/1990 Waller ..... E04D 3/24 52/542
4,949,522 A * 8/1990 Harada ..... E04D 1/04 52/537
5,048,255 A * 9/1991 Gonzales ..... E04D 1/08 52/537
5,060,444 A * 10/1991 Paquette ..... E04D 1/2918 52/526
5,074,093 A * 12/1991 Meadows ..... E04D 3/32 52/537
5,305,570 A * 4/1994 Rodriguez ..... E04D 1/2916 52/520
5,615,527 A * 4/1997 Attley ..... E04D 1/18 52/518
5,630,305 A * 5/1997 Hlasnicek ..... B29C 45/00 264/220
5,743,059 A * 4/1998 Fifield ..... E04D 1/04 52/748.1
6,282,858 B1 * 9/2001 Swick ..... E04D 1/22 52/302.1
6,598,353 B1 * 7/2003 Reeves ..... E04D 1/36 52/302.6
D538,448 S * 3/2007 Fifield ..... D25/140
8,209,926 B2 * 7/2012 McCowen ..... E04D 13/103 52/173.3
8,256,180 B2 * 9/2012 Fink ..... E04D 1/04 52/26
8,572,921 B2 * 11/2013 Ward ..... E04D 1/20 52/518
9,097,019 B1 * 8/2015 Rasmussen ..... E04D 1/34
9,267,296 B2 * 2/2016 Maurer ..... E04D 1/2916
11,047,133 B1 * 6/2021 Barton ..... E04D 3/366
2002/0189188 A1 * 12/2002 Iole ..... E04D 1/20 52/519
2004/0031222 A1 * 2/2004 Porat ..... E04D 1/30 52/302.1
2009/0151287 A1 * 6/2009 Fink ..... E04D 1/2916 52/518
2012/0227352 A1 * 9/2012 Austin ..... E04D 13/004 52/741.4
2016/0123013 A1 * 5/2016 Rasmussen ..... E04D 1/34 52/302.1
2018/0029940 A1 * 2/2018 Drechsler ..... E04D 1/2949
2023/0265659 A1 * 8/2023 Ouyang ..... E04D 1/265 52/520

FOREIGN PATENT DOCUMENTS

DE 3708280 A1 * 9/1988
DE 3708281 A1 * 9/1988
EP 0282718 A1 * 9/1988
EP 0303993 A1 * 2/1989
EP 0432784 A1 * 6/1991
FR 2558195 A3 * 7/1985
FR 3046187 A1 * 6/2017
GB 2599458 A * 4/2022 ..... E04D 1/14
JP 2004245008 A * 9/2004

* cited by examiner (a)

(b)

(a)

(b)

INJECTION-MOLDED ROOF PANEL WITH IMPROVEMENTS

FIELD

The present disclosure is in the field of civil engineering, industrial manufacturing, house building, roofing systems, roof shingles, roof panels, metal roofing, injection molding, sound reduction, and especially, an injection molded roof panel with a corrugated structure, condensed water ridges, angled weep holes, two-way interlocking, and non-smooth low-noise upper surface.

BACKGROUND

A roof covers a building to protect it from bad weather. It often forms a roof pitch. The pitch is the angle, slope, or the steepness at which the roof rises from its lowest point to its highest. A sufficient pitch allows the roof to quickly shed water away from the building and effectively protect its structure.

Roofs can be made of various materials. Traditionally, roofs were thatched with vegetation like straw, reeds, palm branches, etc. Another traditional roofing material included clay or stone tiles. More modern roofing materials include asphalt shingles and concrete tiles. These roofing materials have various problems, but one common problem is that their life spans are sometimes not long enough.

Metal roof panels have been recently used as a roofing material to prolong life expectancy. In a sense, metal roof panels are often claimed as permanent roofs, meaning they will last long enough to cover the full lifetime of the house. These panels are often corrugated for improved strength and aesthetics. Apart from its longevity, other advantages of metal roofing are its high resistance and impermeability.

However, metal roofing has its own set of problems: (1) metal roofing will eventually rust after approximately 50 years, making them not truly permanent as often claimed. This rusting may happen earlier if the roofing is not properly installed and/or maintained; (2) condensation or condensed water often forms on roof panels that may shorten the life expectancy. This is particularly a problem when condensation often forms underneath the roof, causing rust and affecting the building's underlying wooden structure via dampening and corruption. This condensation can form at random locations and can be very difficult to collect or dry. This condensation can cause other problems like mold or weed; (3) existing roofing screw holes or bosses often leave the screws exposed outside the roof in the weather, which causes them to rust and/or possibly dislodge with leaking. They also look ugly on the building. Furthermore, installing a roof panel with such screw holes requires additional skills, which may affect the roof panel's installation speed and quality. So, poorly installed roof panels are less secure and may end up being displaced as a result of screw displacement; (4) metal panels are noisier in the rain and/or wind. So, rain droplets exert a downward force at the impact point that causes a panel vibration, and the vibration may travel further through the building structure, creating a series of noises that are often loud enough to be heard by people inside and/or outside the house; (5) metal roof panels normally have a smooth surface that makes it slippery, particularly when the surface is wet. This makes it dangerous for workers during bad weather conditions like rain; (6) the metal roof panels are often thin, so they may be displaced, warped, and blown away by the wind if they are not properly installed.

Some existing products help to address these issues. For example, to combat condensation, roof tiles and panels will often have vents to encourage air circulation. Roof panels also typically have a drainage hole or a weep hole to expel water from underneath the roof. However, such holes are only really helpful around the section near said holes. In another example, an anti-condensation membrane is applied to the roof panels, which is insulated and absorbs water. This insulation could also be used to dampen noise from rainfall. However, this membrane is often meant for the exposed external surface rather than the concealed internal surface. As a result, roof panels can get wet and corrode from underneath. Hereinafter, the external or exterior surface of a roof panel can be referred to as the 'upper surface' and the internal or interior surface can be referred to as the 'lower surface'.

When addressing wind resistance, some existing panels use interlocking mechanisms to secure one roof panel to another. However, this interlocking is often only done along the panels' lengths, their longitudinal axis, or the latitudinal axis alone. This may lead to uneven gaps between roof panels. Furthermore, other existing interlocking mechanisms may still leave the screw exposed.

Some existing panel designs address the problem of the exposed screw by covering it with the panel's surface. However, installing the screw on the roof sheathing still needs adequate skill to be done properly, takes time to set up, and may not guarantee secure placement on the roof sheathing. Therefore, a better and easier way to secure a tile or panel on the roof sheathing/deck is needed.

On top of the major issues with metal roofing, the panels can also be heavy and/or expensive. One way to address this is to manufacture polyvinyl chloride (PVC) roof panels using injection molding to create a more complicated structure that can be both light in weight and cheaper in cost. More importantly, PVC roofing will not rust, so it lasts longer than traditional or modern roofing like metal roofing.

The present disclosure provides a design for an injection molded roof panel with a special corrugated structure, condensed water ridges, angled weep holes, two-way interlocking, and non-smooth low-noise upper surface that improves upon the following: (1) improved drainage of condensed water and surface rainwater; (2) increased installation security and speed of roof panels on the building; (3) improved wind resistance; (4) increased worker safety; (5) lighter weight and lower cost; (6) improved noise control; (7) improved lifespan.

SUMMARY

The present disclosure provides a new design for an injection molded roof panel with a plurality of improvements over the traditional metal roof panels. The purposes of the present disclosure are to increase the roof's overall life span, keep the concealed lower surface as dry as possible, reduce noise generated by the roof, prevent accidents (i.e., slips and falls) on the roof, reduce installation costs, and secure the placement of roof panels on the building. The design comprises a single specially corrugated roof panel or sheet with the following aspects: a corrugated sloped structure, condensed water ridges or ribs, angled weep holes, two-way interlocking, and a non-smooth low-noise upper surface; i.e. (1) sloping along the roof panel length and watercourse widths; (2) two-way (i.e., horizontal and vertical) interlocking mechanisms; (3) condensed water ridges; (4) angled weep holes; (5) a non-smooth upper surface texture design with features like studs or cones; (6) screw flanges with screw bosses; (7) injection molded polyvinyl chloride (PVC) or other plastic material; (8) large standard form factor.

The roof panel sheet has a special corrugated structure. In one of the preferred embodiments, it has multiple curved watercourses to drain rain from top to bottom along the upper surface of the panel. There are arches and watercourses that alternate along the lateral width of the roof panel. The first aspect of the present disclosure involves the lateral and longitudinal sloping of the roof panel for better rain/water collecting and draining. The lateral sides of each watercourse slope or curve downward along the lateral axis so that water drains from the periphery of the watercourses to the center. The upper surface of the whole roof panel is sloped along its entire length or longitudinal axis. The rear end of the panel starts out as flat but becomes increasingly sloped or curved along the longitudinal axis towards the front end.

The second aspect of the present disclosure involves two-way interlocking with horizontal and vertical interlocking mechanisms involved in connecting adjacent roof panels. There is one arch at one lateral end of each panel. The arch is halved to make a lateral interlocking member that can match and lock the arch at the opposite lateral end of another roof panel: an overlock lines up with the upper surface of a watercourse at one end of the panel, forming the upper half of an arch; an underlock lines up with the lower surface of a watercourse at the other end of the panel, forming the lower half of an arch. These sections are used for horizontal interlocking with horizontally adjacent panels. Here, the overlock of one roof panel connects with the underlock of a horizontally adjacent roof panel.

The front section of one roof panel has a bottom interlocking member or called tongue. The tongue is a singular piece that extends along the entire width of the roof panel. The posterior or rear section of the panel comprises a singular upper interlocking member and opening along the entire width of the roof panel. These longitudinal interlocking members are used for the vertical interlocking mechanism with vertically adjacent panels. Mainly, the tongue of one roof panel, specifically its horizontal insertable portion, fits into the opening of an upper interlocking piece from another roof panel. With horizontal interlocking, the overlock along the first watercourse of one roof panel is connected to the underlock of the last watercourse of another roof panel. The front section is normally installed lower than the rear section.

The third aspect of the present disclosure involves condensed water ridges or ribs along the lower surface of each watercourse. Each ridge runs under a roof panel along the entire length of the panel from the rear section to the front section. Any condensation water forming anywhere under the panel is being eventually collected and led along these ridges and drains toward the front section or front interior space of the panel. The front section is curved from the peripheral to the center so that the center portion is lower than the peripheral, that is, the center portion is the lowest. Therefore, after being installed on a roof, any water, condensed or otherwise, from the panel's lower surface reaching to the front section will be collected around the center part due to gravity and drained out through weep holes located along the diagonally angled portion of the tongue below each watercourse.

The fourth aspect of the present disclosure involves angled weep holes located along the diagonal of the tongue; there is one directly under each watercourse. The weep holes face diagonally downward against the roof surface and are concealed by the front face of the roof panel. Dripping water on the lower surface of the panel is collected at the front center of each watercourse to be drained through the weep hole. Because the roof panels are angled to match a building roof's pitch, the weep holes from one panel expel water onto the upper surface of a vertically adjacent next roof panel. This achieves the water inside the roof is drained to the outside of the roof.

The fifth aspect of the present disclosure is the non-smooth low noise upper surface design of the roof panel. The upper surface of the roof panel is designed to have regularly or irregularly arranged features like studs or cones that can be easily made through the injection molding process. For example, studs or bumps are situated diagonally along the upper surface of the panel. These studs create a rough upper surface texture that prevents slips and falls during roof installation. Furthermore, the upper surface texture can help to dampen noise from the rain or wind by converting the force of impact into smaller component forces that may become noiseless therefore reducing the overall force that generates noises.

The sixth aspect involves a number of screw flanges connected together behind the upper interlocking piece; one screw flange is located vertically adjacent to one watercourse. Each screw flange has a screw hole or boss, which secures a screw onto the roof sheathing to keep the entire roof panel in place. Using the vertical interlocking mechanism, a vertically adjacent roof panel covers the screw flanges to further protect the screws in place.

The seventh aspect is that the roof panel is made out of polyvinyl chloride (PVC) or other injection moldable materials. In some embodiments of the present disclosure, the roof panel is injection molded, where molten PVC material is injected and cooled inside a mold to create a single roof panel when complete. As a result of mass manufacturing via injection molding, another dependent aspect involves manufacturing standard large roof panel, so each panel covers a large area of roof area, therefore, reducing the time and effort to install a roof and a large manufactured roof panel size that can be brought to a worksite and cut to the required size for more flexibility.

By using the above design, the overall installation and use of roof panels are improved by achieving the following: (1) improved water drainage on the upper surface (from rain) and lower surface (from condensed water) thanks to the sloped surfaces, condensed water ridges, and angled weep hole; (2) increased installation security and speed of roof panels on the building thanks to the two-way interlocking, screw flanges, the non-smooth panel surface, the PVC injection molding to form the panel, and the large panel size that can be adjusted on site; (3) improved wind resistance increased thanks to the two-way interlocking and angled weep holes; (4) increased personnel safety thanks to the non-smooth panel surface; (5) improved noise control thanks to non-smooth panel surface; (6) lighter weight and reduced installation cost thanks to PVC design via injection molding; (7) improved panel lifespan thanks to PVC material being non-corrodible from condensation, covered screws being held in the flanges for longer and protected by adjacent roof panels, and condensed water ridges for keeping the interior surface (lower surface) dry.

BRIEF DESCRIPTION OF THE DRAWINGS

The accompanying drawings, which are included to provide a further understanding of the invention and are incorporated in and constitute a part of this application, illustrate embodiment(s) of the present disclosure and, together with the description, serve to explain the principle of the invention. For simplicity and clarity, the figures of the present disclosure illustrate a general manner of construction of various embodiments. Descriptions and details of well-known features and techniques may be omitted to avoid unnecessarily obscuring the discussion of the present disclosure's described embodiments. It should be understood that the elements of the figures are not necessarily drawn to scale. Some elements' dimensions may be exaggerated relative to other elements for enhancing the understanding of described embodiments. In the drawings.

DETAILED DESCRIPTION

Figure 1:
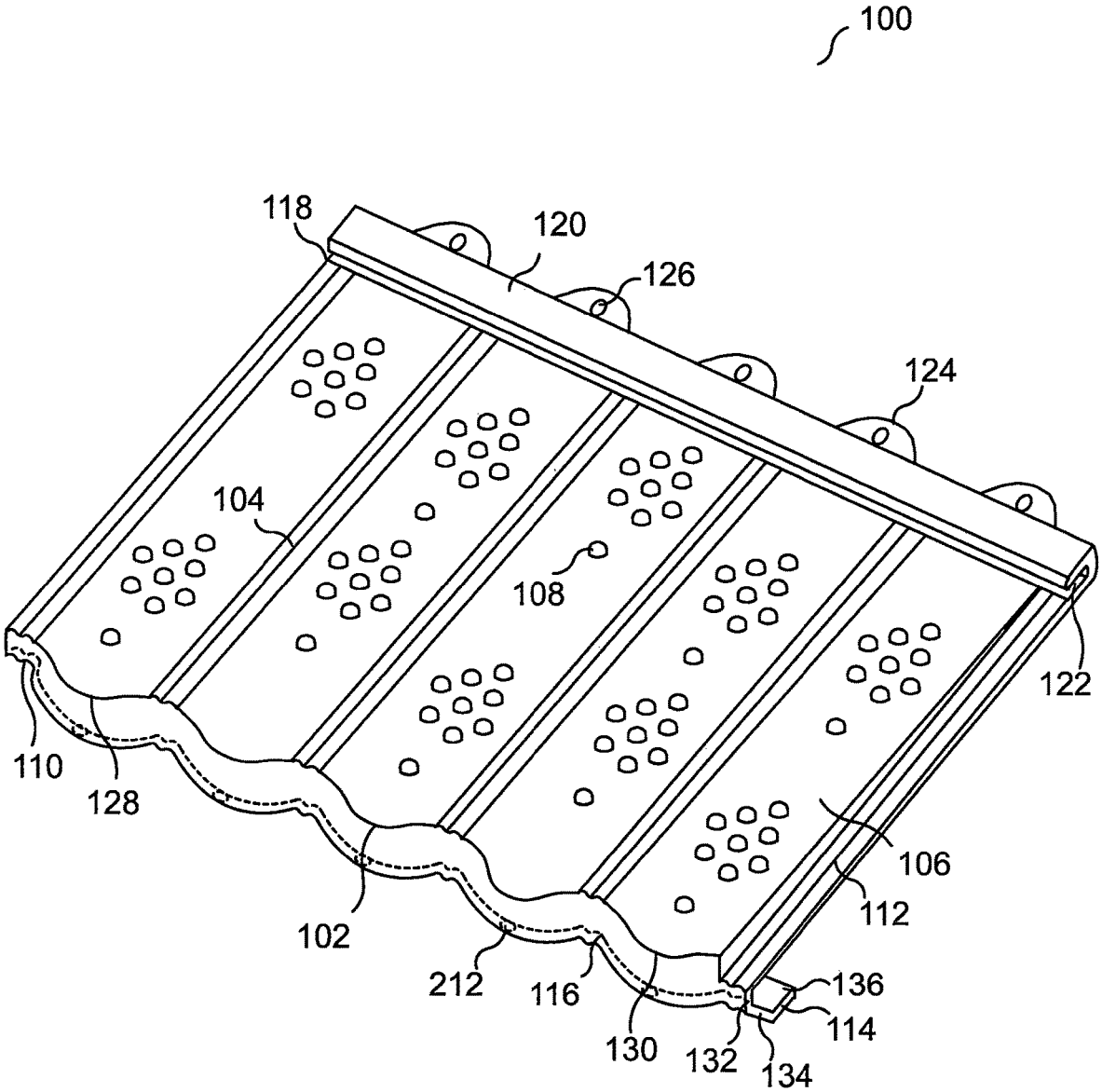
FIG. 1 illustrates an overall perspective view of a preferred embodiment of the present disclosure.

The present disclosure provides a new roof panel with several improvements over traditional metal, fiberglass, or other roof panels that can be manufactured using the injection molding method. Various examples of the present invention are shown in the figures. However, the present invention is not limited to the illustrated embodiments. In the following description, specific details are mentioned to give a complete understanding of the present disclosure. However, it may likely be evident to a person of ordinary skill in the art; hence, the present disclosure may be applied without mentioning these specific details. The present disclosure is represented as a few embodiments; however, the disclosure is not necessarily limited to the particular embodiments illustrated by the figures or description below.

The language employed herein only describes particular embodiments; however, it is not limited to the disclosure's specific embodiments. The terms "they", "he/she", or "he or she" are used interchangeably because "they", "them", or "their" are considered singular gender-neutral pronouns. The terms "comprise" and/or "comprising" in this specification are intended to specify the presence of stated features, steps, operations, elements, and/or components; however, they do not exclude the presence or addition of other features, steps, operations, elements, components, or groups.

Unless otherwise defined, all terminology used herein, including technical and scientific terms, have the same definition as what is commonly understood by a person of ordinary skill in the art, typically to whom this disclosure belongs. It will be further understood that terms, such as those defined in commonly used dictionaries, should be interpreted as having the same meaning as defined in the context of the relevant art and the present disclosure. Such terms should not be construed in an overly strict sense unless explicitly described herein. It should be understood that multiple techniques and steps are disclosed in the description, each with its own benefit. Each technique or step can also be utilized in conjunction with a single, multiple, or all of the other disclosed techniques or steps. For brevity, the description will avoid repeating each possible combination of the steps unnecessarily. Nonetheless, it should be understood that such combinations are within the scope of the disclosure. Reference will now be made in detail to some embodiments of the present invention, examples of which are illustrated in the accompanying figures.

A new roof panel in a preferred embodiment is corrugated and comprises multiple curved watercourses or water channels connected with arches. The arches are between two watercourses in the lateral direction. In a sense, the lateral edge of the roof panel has a wavy alternating pattern between arches and watercourses with the arches peaking at the top and watercourses peaking at the bottom of the panel. The watercourses are laterally sloped upper surface of the roof panel in the shape of a capital letter 'U'. Rainwater drains downward from the top of the roof panel to the bottom. The water will mainly flow along and inside of the watercourses. The water may start from the lateral ends at the top of the watercourse, then sides of a watercourse center, and finally at the watercourse bottom. This lateral sloping is more pronounced at the front of the roof panel. Herein lies the lateral sloping element of the first aspect.

In the second element of the first aspect, the entire length of the panel is sloped. More specifically, the upper surface along the panel's longitudinal axis is sloped. The roof panel starts out flat at its rear, but its upper surface progressively slopes upward toward the panel's front. In another sense, the distance between the panel's upper surface and lower surface increases from the rear to the front. Since the roof panel is installed along a downward roof pitch, the roof panel will face downward and the water will drain downward toward the front of the panel. Both the lateral sloping and longitudinal sloping complement each other to better collect (funnel to a centralized point) and drain rainwater (downward away from the building) from the upper surface of the panel.

In the second aspect of the present disclosure, the roof panel has two-way interlocking that uses horizontal and vertical interlocking mechanisms to safely lock with a panel to horizontally and vertically adjacent roof panels. These mechanisms rely on interlocking pieces at the lateral and longitudinal ends of the roof panel. Because these interlocking pieces are integrated with the roof panel in the present disclosure, hereinafter, the term 'interlocking piece(s)' may be interchangeable with 'interlocking member(s)'. With the horizontal interlocking mechanism, the arches at the lateral ends of each panel are modified half-arches that function as lateral interlocking members between horizontally adjacent panels. Looking at the front of the panel, the left side of the panel has a left interlocking member, hereinafter referred to as the 'overlock'. This overlock makes up a top half of a standard arch, which is in line with the upper surface of the roof panel. The right side of the panel has a right interlocking member, hereinafter referred to as the 'underlock'. This underlock makes up a bottom half of a standard arch, which is in line with the lower surface of the roof panel. For horizontal interlocking, the overlock of one roof panel would be placed and secured on top of an underlock of another panel.

There are also interlocking members at the longitudinal ends of the roof panel: the rear of the panel has an upper interlocking member with an upper interlocking opening. The upper interlocking member is one long integrated rectangular piece along the lateral axis or width of the panel's rear section. Naturally, there is only one rectangular opening along the front center of the upper interlocking member; the front of the panel has a bottom interlocking member, hereinafter used interchangeably with the term 'tongue'. This tongue is a single angled piece along the lateral axis or width of the panel's front section up to the left side of the panel's left watercourse. The tongue has three portions: a vertical portion that is behind the front of the underlock. This vertical portion then merges with the rest of the front section of the panel; an angled diagonal portion that is angled downward below the panel throughout its lateral width; a horizontal insertable portion that extrudes inward from the lower end of the diagonal portion. The tongue is generally concealed behind the front face of the roof panel, as its lateral face is perpendicularly adjacent to the lateral edge of the underlock. Both the upper and bottom interlocking members play a role in the vertical interlocking element of the aspect. So, the tongue of one roof panel, mainly its insertable portion, is inserted and secured in the upper interlocking member of another roof panel via the upper interlocking opening. The horizontal and vertical interlocking mechanisms work together to improve several things. The most obvious is the increased security of the roof panel on the roof sheathing and deck. Because of this increased security, the panels are more resistant to strong winds. The vertical interlocking mechanism allows vertically adjacent panels to cover the screw/nail flanges, further increasing the security. The front section is normally installed lower than the rear section.

The third aspect involves condensed water ridges or ribs that are present on the concealed lower surface of the panel along the panel's longitudinal axis from the rear section to the front section. More specifically, a number of elongated condensed water ridges are located along the length of each watercourse's lower surface; these ridges are equally spaced apart from one another along the curved lower surface. The ridges collect and lead any condensation forming anywhere under the roof panel. With the panel's longitudinal sloping, the watercourses are also longitudinally sloped. This causes the condensed water to travel along the condensed water ridges, draining it toward the front interior space of the panel and eventually expelled by angled weep holes. The front section of the roof panel is curved from the peripheral to the center so that the center portion is lower than the peripheral, that is, the center portion is the lowest. Therefore, after being installed on a roof, any water, condensed or otherwise, from the panel's lower surface reaches to the front section will be collected around the center part due to gravity and drained out through weep holes located along the diagonally angled portion of the tongue below each watercourse.

Angled weep holes are the fourth aspect of the present disclosure. Five circular weep holes are located at the front bottom of the panel along the diagonal portion of the tongue: one weep hole is directly located underneath each watercourse. The angled weep holes drain water (condensation or leakage) from the lower surface of the panel with the help of condensed water ridges. With the help of the vertical interlocking and longitudinal sloping aspects, any water will dispel directly onto the upper surface of a vertically adjacent panel and will travel away from the building. The angled weep holes, along with the sloping and the condensed water ridges, generally provide improved condensed water drainage. As a result, the lifespan of the panel is improved since the drainage of condensed water from these aspects keeps the panel dry and prevents problems like corrosion, mold, etc.

The fifth aspect involves the non-smooth low noise upper surface texture on top of the roof panel. The roof panel has a rough or irregular texture that is designed with studs or cones that are regularly or irregularly placed on the upper surface of the panel depending on the embodiment. In the preferred embodiment, the studs are arranged in a regular diagonal pattern throughout the panel's upper surface. Hereinafter, the term 'non-smooth low noise upper surface texture design' can be interchangeably referred to as 'non-smooth texture', 'upper surface texture', 'studs', 'bumps', or 'cones'. The studs on the upper surface texture are primarily located on top of the watercourses in the preferred embodiment but can be located and arranged all throughout (arches included) the upper surface. The studs from the upper surface texture provide increased friction, which prevents slips and falls for workers on the roof, particularly when roof panels are wet. Furthermore, the non-smooth texture reduces noise from rain falling down and hitting the surface texture. Rain normally hits the upper surface of a panel with an initial force or F0. This force acting on the roof panel will cause a vibration that creates a loud sound. Thanks to the studs on the upper surface texture, rain hitting the upper surface texture will likely hit the studs, reducing F0 into two component forces: a remaining force (F1) that makes noise and a reduced force (F2) that does not make noise. As a result, the vibration caused by F1 will be weaker and not cause as much noise. It should be noted that such studs on the panel are made at the same time as the rest of the panel with injection molding of the entire panel. In a sense, this makes manufacturing the panel quicker and cheaper since no extra steps or labor are required for implementing this non-smooth upper surface texture. Furthermore, installation speed is possibly faster because a worker can stand on one roof panel when it is dry or wet, and install more panels without the risk of slipping and causing injury.

The sixth aspect involves covering and securing screws into multiple screw flanges behind the panel's rear side. Multiple half-circle flanges extend from the rear of the panel, specifically the upper interlocking member; there is one flange in line with each watercourse. The bottom face of the flanges makes contact with the roof sheathing's upper surface. The flanges also line up laterally and form a singular wave piece. Each flange has one screw hole or boss for inserting a screw from the top of the flange. The inserted screw is secured onto the roof sheathing and deck. Using the vertical interlocking mechanism of the second aspect, the tongue at the front of a vertically adjacent panel is inserted into the upper interlocking opening; the former panel covers the screw and screw flanges of the latter panel as a result. Because the screws are secured inside the flanges upon installment, the panel can be installed more securely and can last longer since the screw is not exposed and is less likely to corrode or be dislodged. As noted before, vertically adjacent panels cover both the screw flange and screw using the vertical interlocking mechanism. Panel installation can also be done quickly with less skill since the screw boss acts as a guide to insert and install the screw.

The seventh aspect is that the roof panel is made out of polyvinyl chloride (PVC). The roof panel is injection molded, where all components of the roof panel are outlined in a mold and molten PVC material is injected and cooled inside the mold. Once the PVC is cooled, the mold is removed to form a finished roof panel. As a result of mass manufacturing via injection molding, an eighth aspect is observed through the large manufactured panel size that can be brought to a worksite and cut to the required size. The PVC material and the potentially large size bring many benefits, the most obvious is the light weight and the reduced installation cost. Injection molding is a quick and easy way to manufacture the roof panel. This process is automated and can produce a large quantity in a short amount of time, meaning they can be deployed to be installed more quickly at a cheaper cost. Another notable benefit is that PVC is not susceptible to corrosion. So even if condensation forms, the life expectancy is still maintained compared to metal roof panels. Relating to the large size aspect, panel installation speed can be increased in a few ways. First, the large panel size can cover a large area of a roof, meaning that fewer panels may be needed. Second, the PVC material of the roof panel makes them light to carry so that they can be moved onto the roof sheathing/deck and be handled more quickly. Third, if the panel needs to be cut to cover a roof edge, it is easier to cut it on the spot. With metal panels, they need to be cut at a shop with specialized equipment that is not portable and/or needs considerable skill. So, if a panel needs to be cut during the installation process, the panel would need to be brought back to the shop to cut at the specific measurements. With an injection-molded roof panel, measurements can be quickly taken on-site, and the panel can be cut. This allows roof panel installation to progress more quickly.

FIG. 1 illustrates a general perspective view of the preferred embodiment of the present disclosure. Looking at the figure, the roof panel (100) is shown with the front section (116) facing the lower left side and the rear section (118) is facing the upper right side. The roof panel (100) comprises five watercourses along the lateral axis of the panel (100): a first watercourse (128) located on the left side of the panel (100); three central watercourses (102) in the middle of the panel (100); a last watercourse (130) on the right side of the panel (100). Each watercourse (102, 128, 130) is laterally curved along its width, forming a 'U-shape' so that water on the sloping sides of the watercourses (102, 128, 130) drains towards the center portion of the watercourses (102, 128, 130). The upper lateral ends of the watercourses (102, 128, 130) are connected to one another via arches (104) that are 'm-shaped'; there are four arches (104) at the center of the panel (100). The upper surface (106) of the panel (100) is sloped along the longitudinal axis with the rear section (118) being flat and the front section (116) being sloped in an upward direction. The upper surface (106) also has a non-smooth texture (108) on the upper surface (106) with studs (108) placed in a diagonal pattern, where one stud (108) is diagonally adjacent to another.

The lateral ends of the roof panel (100) consist of two modified half-arches that function as lateral interlocking members between horizontally adjacent panels (100): a left interlocking member or overlock (110) is located on the left side of the first watercourse (128) and the whole roof panel (100). The overlock (110) is in line with the upper surface (106) of the roof panel (100); a right interlocking member or underlock (112) is located on the right side of the first watercourse (130) and the whole roof panel (100). The underlock (112) is in line with a lower surface of the roof panel (100).

The front section (116) of the roof panel (100) also comprises a bottom interlocking member or tongue (114). The tongue (114) comprises three portions: a vertical portion (132) behind the underlock (112), a diagonal portion (134), and an insertable portion (136). Looking at the figure, the vertical portion (132) of the tongue (114) is shown perpendicular to the front of the underlock (112); the tongue (114), particularly the diagonal portion (134) and the insertable portion (136), is a whole is one singular member along the width of the roof panel (100) up to the left lateral end of the first watercourse (128). The tongue (114) is concealed by the face at the front (116) section of the panel (100). The rear section (118) of the roof panel (100) also has a rectangular upper interlocking member (120) with an upper interlocking opening (122) that is present along the entire width of the panel (100). The tongue (114), particularly the insertable portion (136), of one roof panel (100) fits into the interlocking opening (122) of another panel (100).

There are five half-circular screw flanges (124) located behind the upper interlocking member (120). Each screw flange (124) lines up with a watercourse (102, 128, 130) and connects with one another to make one wavy piece. Each screw flange (124) has a screw hole (126) or boss to allow a screw to fit through and secure the panel (100).

The figure shows sloped surfaces along the lateral and longitudinal axes of the roof panel (100). The watercourses (102, 128, 130) all have a U-shape that brings water from the arches (104) down to the center of the watercourses (102, 128, 130) for lateral sloping. The alternating pattern of the watercourses (102, 128, 130) and arches (104) result in the front section (116) having a face in the shape of a sinusoidal wave. Longitudinal sloping is evident mainly with the upper surface (106) of the panel, most visible where the underlock (112) is located. At the rear section (118) of the panel (100), the upper surface (106) is perfectly in line with the bottom of the upper interlocking opening (122). The upper surface (106) of the panel (100) is also in line with the upper surface of the underlock (112). However, the upper surface (106) gets increasingly higher toward the front section (116) of the panel (100), which can be seen in the drawing with the upper surface (106) being farther apart from the underlock (112) from the rear (118) to the front (116). In another sense, the upper surface (106) is sloping upward when the panel (100) is lying flat as shown in the figure. However, the panel (100) slopes downwards when it is installed along a pitched roof sheathing and deck; this will be further shown in FIG. 3.

It should be noted that the longitudinal sloping of the upper surface (106) is illustrative and not limited to the angle shown in the figure. The upper surface (106) sloping may be shown angled toward the front section (116) at any degree depending on the embodiment. This modification to the longitudinal sloping may affect the rainwater drainage on the upper surface (106) of the panel (100).

The shape of the panel (100) in the preferred embodiment is generally rectangular with a front section (116) having a face in the shape of a sinusoidal wave. However, this is mainly for illustrative purposes, and the panel (100) and its front section (116) are not limited to these shapes. The panel (100) itself may be circular, triangular, or any other suitable shape depending on the embodiment. The front section (116) is generally wavy, but it can be a different wave shape depending on the embodiment like square, triangle, saw-tooth, etc.; this will depend on the shape of the watercourses (102, 128, 130).

As the roof panel (100) is made of PVC, it can be manufactured with a large size. The large size generated can increase the speed of roof panel (100) installation in a few ways: (1) a large panel (100) can cover a fairly large area of the roof deck. This means that fewer panels need to be secured on the roof sheathing; (2) the PVC material is lightweight and can be carried to the top of the building more easily; (3) a large PVC panel (100) can be measured and cut into smaller pieces on the spot. By comparison, a corrugated metal panel is measured and cut in a workshop prior to use at a construction site. If, however, the metal panel needs to be cut, it usually needs to be brought back to the shop to cut. Even if they can be cut on-site, more time and specialized tools would be needed. In either case, cutting a metal panel slows down roof installation. Additionally, metal roof panels are heavier.

It should be noted, however, that the size (length and width) of the panel (100) is shown for exemplary purposes, and is not limited to the size shown in the figure. The panel (100) may be laterally narrower or wider and/or longitudinally longer or shorter depending on the embodiment. However, modification of the panel's (100) components, such as the watercourses (102, 128, 130), arches (104), interlocking members (110, 112, 114, 120), etc. may be affected as a result.

It should also be noted that the quantity and sizes of the panel's (100) components, including the watercourses (102, 128, 130), arches (104), screw/nail flanges (124), and interlocking members (110, 112, 114, 120) are illustrative and not limited to what is shown in the drawing. Depending on the embodiment, the number of specific components may vary for the panel (100). For example, a panel may have three watercourses (102, 128, 130) with three nail flanges (124). The size of these components may be larger or smaller depending on the embodiment. For example, one lateral end of a watercourse (102, 128, 130) may be farther or narrower apart from another lateral end. Such modifications to the number and size of panel (100) components would presumably affect the size (length and width) of the entire panel (100).

The watercourses (102, 128, 130) are 'U-shaped' in the preferred embodiment of the present disclosure. This particular shape is used for lateral sloping, where water drains from the lateral sides of the watercourses (102, 128, 130) to the middle part of the watercourses (102, 128, 130). However, the shape of the watercourses (102, 128, 130) can be considered illustrative and, therefore, the watercourses (102, 128, 130) are not limited to the shape shown in the figure. In other alternative embodiments, the watercourses (102, 128, 130) may be any other shape such as rectangular, triangular, trapezoidal, or any other suitable shape for draining water along the panel's (100) width.

The arches (104), overlock (110), and underlock (112) are 'm-shaped' in the preferred embodiment of the present disclosure. However, this shape is mainly illustrative and is not limited to the shape shown in the figure. In other alternative embodiments, the watercourses (102, 128, 130) may be any other shape such as a circular shape, rectangular, triangular, trapezoidal, etc. In another alternative embodiment, arches (104) are entirely flat since they are merely for aesthetic purposes. The overlock (110) and underlock (112) would also be flat since, yet they would still retain their interlocking function via the horizontal interlocking mechanism. It is noted, however, that the shapes of the overlock (110) and underlock (112) should be the same in order to lock together seamlessly for horizontal interlocking.

In an alternative embodiment, the shapes of the watercourses (102, 128, 130) and the arches (104) are inverted so that the watercourses (102, 128, 130) would form a dome-like shape and the arches (104) form a curvy 'w-shape'. In another alternative embodiment, the arches (104) would be at the bottom of the panel (100) rather than the top, while the watercourses (102, 128, 130) would be situated at the top of the panel (100). In yet another embodiment, both, the shapes and positioning watercourses (102, 128, 130) and the arches (104) are inverted. In this case, the arches (104) would have a more prominent water drainage function.

The overlock (110) and underlock (112) are shown as modified half-arches. When one panel (100) connects with a horizontally adjacent panel using horizontal locking, the interlocking members (110, 112) combine to make up one full arch (104). This will be shown further in FIG. 4.

The upper interlocking member (120) is shown as a rectangular shape. However, this rectangular shape is exemplary and is not limited to such. In some alternative embodiments, the upper interlocking member (120) can be triangular, diamond, circular, elliptical, etc. In other embodiments, the upper interlocking member (120) can have more roundish surfaces rather than flat surfaces; however, this may affect how the roof panel (100) would be installed on the roof sheathing.

It should be noted that the vertical portion (132) of the tongue (114) is mainly present behind the underlock (112) of the panel (100). Throughout the rest of the panel's (100) lateral axis (up to the lateral edge of the first watercourse (128)), the vertical portion (132) merges with the rest of the front portion (116).

The stud (108) placement on the non-smooth texture (108) of the upper surface (106) is arranged in a way where one stud (108) is diagonal from another. The non-smooth texture (108) is also mainly shown on the upper surface (106) of the watercourses (102, 128, 130) as random segments. However, it is mainly illustrative, as the studs (108) would be present all throughout the upper surface (106) of the watercourses (102, 128, 130). Furthermore, the placement and arrangement of studs are not limited to a diagonal arrangement of the upper surface (106) of the watercourses (102, 128, 130). In some embodiments, the studs (108) can be arranged in a circular, squarish, or even an irregular pattern on the upper surface (106) of the panel (100). In other embodiments, the arches (104) and the interlocking members (110, 112, 114, 120) would also have a non-smooth texture (108).

The non-smooth texture (108) on the upper surface (106) is mainly shown with circular studs or cones that are mainly located on the watercourses (102, 128, 130). However, the shape is exemplary and can be any other shape depending on the embodiment. Examples of such alternate shapes may include rectangular pillars, triangular spikes, flat cylindrical prisms, or any other suitable shape. It should be noted that modifying the shape of the studs (108) may affect the noise dampening and anti-slip properties of the roof panel (100).

The roof panel (100) material in the preferred embodiment is made out of PVC from injection molding. This material provides many benefits such as the light weight, longer life expectancy, immunity to corrosion, and more can be produced at cheaper costs. They can also increase panel installation speed since they can be manufactured with a large size and cut at the time of installation if needed. All the components, including the studs (108) of the upper surface (106) can be quickly manufactured via injection molding without extra steps or labor. However, it should be noted that the material used for the panel (100) is exemplary, and is not solely limited to PVC via injection molding. In other alternative embodiments, different polymer materials like polyethylene, polypropylene, can also be used for forming the panel (100) with injection molding. Metal materials, such as steel, iron, copper, etc., may be used in other embodiments. In other alternative embodiments, more traditional materials like clay, ceramic, concrete, or even straw (via thatching) may be used.

Figure 2:
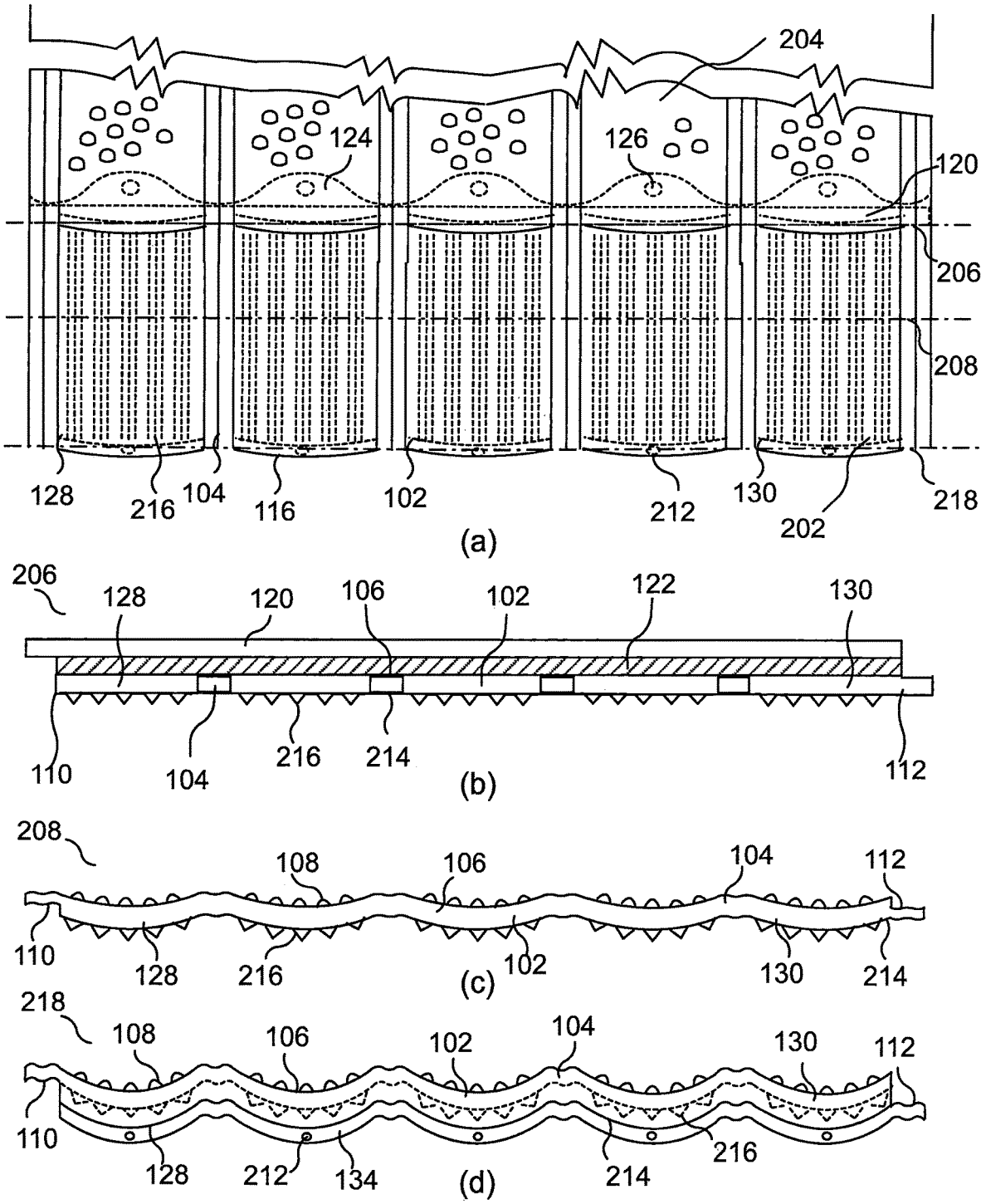
FIG. 2 illustrates the top and three front cross-sectional views of the roof panel in the present disclosure.

FIG. 2 illustrates top and front cross-sectional views of the roof panel in the present disclosure. Sub-figure (a) illustrates a top view of one roof panel vertically interlocked with another roof panel. Looking at the figure, the front sides of a first roof panel (202) and a second roof panel (204) are facing downward. A first roof panel (202) is vertically interlocked with a second roof panel (204), where the front of the second roof panel (204) is aligned and situated on top of the first roof panel's (202) upper interlocking member (120), screw flanges (124), and screw bosses (126). The portion of the first panel's (202) arches (104) and watercourses (102, 128, 130) are also covered by the second panel (204). Individual weep holes (212) are located underneath their respective watercourses (102, 128, 130) at the front of each roof panel (202, 204). The roof panels (202, 204) can be separated into three sections, shown as cross-sectional lines along the first panel (202) in the sub-figure: a rear cross-section line (206) along the rear; a center cross-section line (208) along the middle; a front cross-section line (218) along the front.

The second panel's (204) connection to the first panel (202) is exemplary of the vertical interlocking mechanism, as the front of the second panel (204) practically matches up with the upper interlocking member (120) of the first panel (202) at the rear cross-section line (206). This will be further shown in FIG. 3.

It should be noted that the placement of the second panel (204) on top of the first panel (202) is illustrative and is not limited to the particular position shown in the sub-figure. Depending on the embodiment, the second panel (204) may be placed closer to the front of the first panel (202); however, this may affect the vertical interlocking mechanism, and modifications to the upper interlocking member (120) and the tongue (not shown in this sub-figure) may be required to accommodate this placement change.

The individual screw flanges (124) in the preferred embodiment are shaped as half-circular entities that join together to form one sinusoidal wave. However, this is exemplary and the shape of the screw flanges (124) is not limited to such a shape. In some embodiments, the screw flanges (124) can be different shapes like a square, triangle, etc., many other shapes. In another embodiment, the screw flanges (124) do not connect together to form a singular shape.

There is one screw boss (126) per screw flange (124); however, this is exemplary. Depending on the embodiment, the number of screw bosses (126) per screw flange (124) can vary to be more than one or none. The number of screw bosses (126) per screw flange (124) may also vary between screw flanges (124) in other embodiments.

Sub-figure (b) illustrates a cross-sectional front view of a single roof panel along the rear cross-section line (206). At this cross-section (206), the upper interlocking member (120) is present with the upper interlocking opening (122) at its center. The upper surface (106) of the roof panel is flat and in line with the bottom of the interlocking opening (122). The watercourses (102, 128, 130), arches (104), overlock (110), underlock (112) are shown as thin, flat elements that are all in line with each other. In other words, they are approximately the same size at this rear cross-section line (206). The lower surface (214) of the panel is flat with condensed water ridges or ribs (216). Looking at the rear cross-section (206) in the sub-figure, there are five condensed water ridges (216) evenly spaced out under each watercourse (102, 128, 130).

The upper interlocking opening (122) is shown at the vertical center of the upper interlocking member (120) with a fixed height. It should be noted, however, that this is mainly exemplary, and the height and placement of the upper interlocking opening (122) are not limited to what is shown in the sub-figure. The upper interlocking opening (122) may be positioned higher or lower on the front of the interlocking member (120) with a different height. However, the bottom interlocking member may need to be modified to accommodate such a change.

The placement of the upper surface (106) at this rear cross-section line (206) at the bottom of the upper interlocking opening (122) is mainly illustrative. Hence, the upper surface (106) at the rear cross-section line (206) is not limited to that position along the upper interlocking member (120).

Sub-figure (c) illustrates a cross-sectional front view of a single roof panel along the center cross-section line (208). At this cross-section (208), the watercourses (102, 128, 130), arches (104), overlock (110), underlock (112), upper surface (106), and lower surface (214) are slightly curved into their respective shapes; they also appear to be thicker than in the previous sub-figure, indicating an increased elevation in the upper surface's (106) height. So, at the center cross-section line (208), the watercourses (102, 128, 130) have a slight U-shape. A non-smooth texture (108) is present along the curved upper surface (106) of the watercourses (102, 128, 130). The arches (104), overlock (110), and underlock (112) have a slight m-shape. The overlock (110) at the lateral end adjacent to the first watercourse (128) is in line with the upper surface (106) of the panel. The underlock (112) at the lateral end is adjacent to the last watercourse (130) and is in line with the lower surface (214) of the panel. Condensed water ridges (216) are lined up along the curved lower surface (214) of each watercourse (102, 128, 130).

Sub-figure (d) illustrates a cross-sectional front view of a single roof panel along the center cross-section line (218). At this cross-section (218), the watercourses (102, 128, 130), arches (104), overlock (110), underlock (112), upper surface (106), and lower surface (214) are even more curved with the upper surface (106) elevated even higher than in previous sub-figures. So, at the front cross-section line (218), the watercourses (102, 128, 130) have a more pronounced U-shape. The non-smooth surface texture (108) on the curved upper surface (106) line up accordingly with the modified shape of the watercourses (102, 128, 130). The arches (104), overlock (110), and underlock (112) have a more pronounced m-shape. The overlock (110) and underlock (112) appear to be thicker compared to the previous sub-figures. The condensed water ridges (216) and the lower surface (214) are concealed behind the front face of the panel at this front cross-section (218). The weep holes (212) are present below the watercourses (102, 128, 130); one weep hole (212) is located below each watercourse (102, 128, 130).

It should be noted that the cross-section lines (206, 208, 218) shown on the first panel (202) are placed at their respective positions for reference purposes; however, they are not limited to those specific positions in other embodiments. It is obvious to those skilled in the art that placing the cross-section lines (206, 208, 218) will result in a different cross-section of the exemplary first panel (204) and second panel (204).

The latter three sub-figures exemplify the aspect relating to lateral and longitudinal sloping for draining surface rainwater. The aspect influences the shape of the first and second panels (202, 204) in the latter three sub-figures from the rear cross-section (206) to the front cross-section (218). The lateral sloping is most evident with the watercourses (102, 128, 130) becoming more 'U-like' in shape and the increasing vertical distances between the watercourses (102, 128, 130) and the arches (104). The longitudinal sloping is most evident with the increasing distance between the upper surface (106) and the lower surface (214).

The distance between the upper and lower surfaces (106, 214) may vary between the cross-sections (206, 208, 218) depending on the embodiment. This would affect the longitudinal sloping of the upper surface (106) and the angle of the slope from the rear cross-section (206) to the front cross-section (218). Essentially, the exemplary panel's (202, 204) rainwater drainage may be affected.

In other embodiments, the vertical distances between the arches (104) and the watercourses (102, 128, 130) may vary between cross-sections (206, 208, 218). In other words, the watercourses' (102, 128, 130) gradual transition to their definitive 'U-shape' between may vary cross-sections (206, 208, 218). The change in lateral sloping may influence the rainwater drainage of the watercourses (102, 128, 130).

The condensed water ridge (216) and angled weep holes (212) also contribute to the improved water drainage of the present disclosure; however, they are more dedicated to the drainage of water from the lower surface (214). This will be shown and explained further in FIG. 3.

Each cross-section line (206, 208, 218) shows five condensed water ridges (216) laterally spaced out along the lower surface of each watercourse (102, 128, 130). Looking at the front, the condensed water ridges (216) have a triangular shape with consistent heights from the rear cross-section line (206) to the front cross-section line (218). It should be noted that this is mainly exemplary, so the condensed water ridges (216) are not limited to the quantity, shape, height, and arrangement. In some alternative embodiments, the shape of the condensed water ridges (216) may be circular, squarish, or any other suitable shape. In other embodiments, the condensed water ridges (216) may increase or decrease in height from the rear cross-section line (206) to the front cross-section line (218). In additional embodiments, there may be fewer or more condensed water ridges (216) along the lower surface (214) of each watercourse (102, 128, 130). In yet more alternative embodiments, the condensed water ridges (216) may be clustered on one side of each watercourse (102, 128, 130).

In yet another embodiment, the condensed water ridges (216) may be replaced with hollow grooves along the lower surface (214) of the panel.

There are five weep holes (212) shown at the front cross-section (218) of the panel to drain water from the first and second panels' (202, 204) lower surface (214): one weep hole (212) is located below each watercourse (102, 128, 130). This is mainly exemplary and the number of weep holes (212) at the front of a roof panel, such as the exemplary first and second roof panels (202, 204), is not limited to what is shown in sub-figure (d). Depending on the embodiment, there can be more or fewer weep holes (212). For example, there may be more than one weep hole (212) below the watercourses (102, 128, 130). In another example, there could be one weep hole (212) for alternating watercourses (102, 128, 130). Alternatively, the number of weep holes (212) may depend on the number of watercourses (102, 128, 130) present under alternative embodiments. For example, there are more weep holes (212) because an alternative embodiment may have a roof panel with six, seven, or more watercourses (102, 128, 130).

The front section (116) of the roof panel is curved from the peripheral to the center within each watercourse so that the center portion is lower than the peripheral.

At the center and front cross-section lines (208, 218), the non-smooth texture (108) is shown with five studs (108) along the upper surface (106) of each watercourse (102, 128, 130). Such an arrangement is mainly for illustrative purposes since the studs (108) are arranged throughout the entire upper surface (106) as described in FIG. 1. Additionally, there can be more or fewer studs (108) at the center and front cross-section lines (208, 218) depending on the embodiment.

Figure 3:
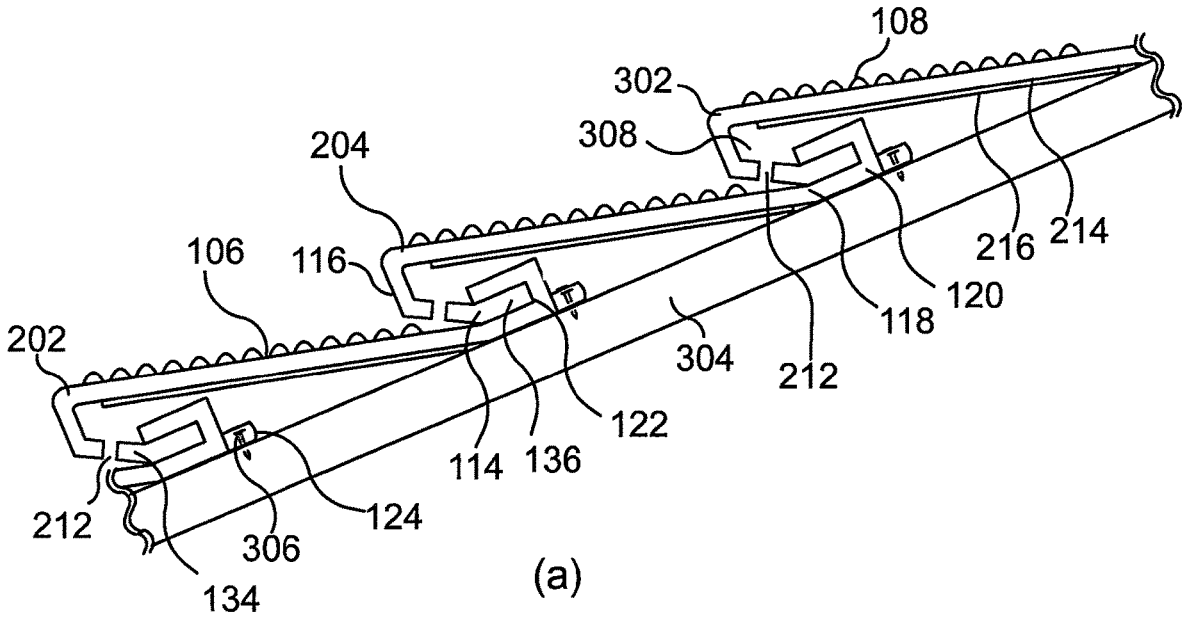
FIG. 3 illustrates central cross-sectional side views of roof panels connected with the vertical interlocking mechanism, water drainage, and screw installation of the roof panel in the present disclosure.
Figure 3:
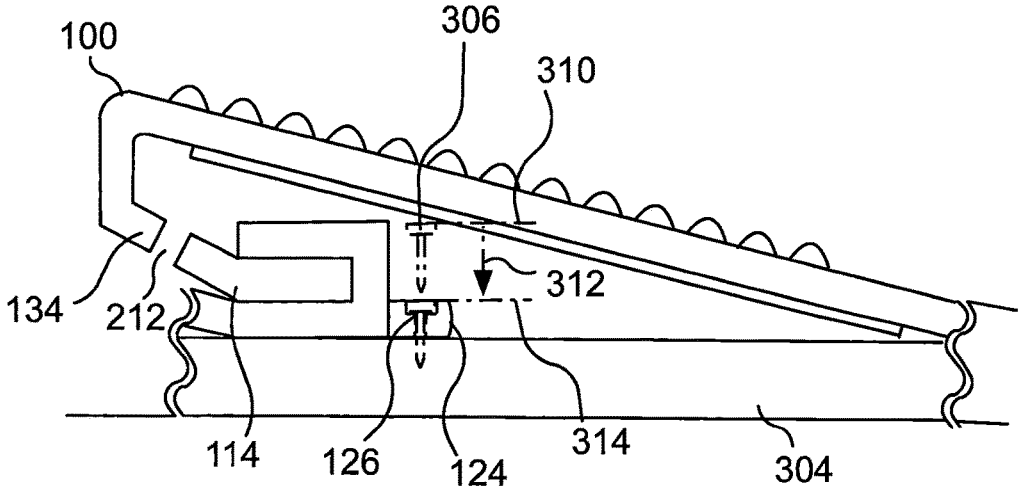

FIG. 3 illustrates cross-sectional side views of roof panels connected with the vertical interlocking mechanism, water drainage, and screw installation of the roof panel in the present disclosure. Sub-figure (a) illustrates a cross-sectional side view of vertically adjacent first, second, and third roof panels (202, 204, 302) installed on the roof sheathing (304) and attached to one another via the vertical interlocking mechanism. Hereinafter, the first, second, and third roof panels (202, 204, 302) can be interchangeably referred to as 'the three exemplary panels' for the rest of the figure description. The sub-figure also shows the means of water drainage for the first, second, and third roof panels (202, 204, 302). Looking at the sub-figure, the top of the roof would be on the upper right side and the bottom of the roof would be on the lower left side. So, the rear sections (118) of the three exemplary roof panels (202, 204, 302) would be facing the upper right, and their front sections (116) would be facing the lower right. A first panel (202) is installed on the pitched roof sheathing (304); the bottom sides of its upper interlocking member (120) and the nail flanges (124) at the first panel's (202) rear section (118) are in line with the top side of the roof sheathing (304). A screw (306) is installed inside the first panel's (202) screw flange (124). The first panel's (202) tongue (114) at the front section (116), particularly its insertable portion (136), is inserted into the upper interlocking opening (122) of a vertically-adjacent panel below. A second panel (204) is installed above the vertically adjacent first panel (202) in the same manner as described for the first panel (202). A third roof panel (302) is shown installed above the vertically adjacent second panel (204) in the same manner as described for the first panel (202).

Condensed water ridges (216) are shown directly below the lower surface (214) of the first, second, and third panels (202, 204, 302). Since the three exemplary panels (202, 204, 302) are sloped downward along the pitch of the roof sheathing (304), the condensed water ridges (216) are also sloped in the same manner. Condensation travels downward along the condensed water ridges (216) to the front section (116) of the panels (202, 204, 302). The condensed water is then collected in a front interior space (308) of the three exemplary panels, where it is drained via their angled weep holes (212) on the diagonal portion (134) of their respective tongues (114). The drained water (from condensation or leakage) then travels on the upper surface (106) and associated surface texture (108) of the vertically adjacent panels (202, 204) below. In this case, water exiting the weep hole (212) of the third panel (202) would travel on the upper surface (106) of the second panel (204), where it will then flow past the second panel's (204) front section (116) down to the upper surface (106) of the first panel (202). The description of water flow from the weep holes (212) of the first and second panels (202, 204) is the same as described above.

The sub-figure demonstrates the downhill longitudinal sloping aspect for general roof panels, even if the roof panels, such as the three exemplary panels (202, 204, 302) in the sub-figure, are shown with an upper surface (106) that is sloping upward. Because the pitch of the roof sheathing (304) is heading downward, the three exemplary panels (202, 204, 302) will also be angled downward. So, water can still exit from the weep holes (212) and drain along the longitudinal axis of the three exemplary panel's (202, 204, 302) upper surfaces (106). In other words, water will be drained away from the building itself. Combined with the condensed water ridges (216) and the angled weep holes (212), the sub-figure exemplifies how improved water drainage is achieved using the exemplary panels (202, 204, 302) in the sub-figure.

Because of the condensed water ridges (216) and the angled weep hole (212), roof panels (i.e., the three exemplary panels (202, 204, 302)) and the roof as a whole can also experience a longer life expectancy. First, the lower surfaces (214) of the roof panels (i.e., the three exemplary panels (202, 204, 302)) can be kept dry. Second, the PVC material the roof panels (i.e., the three exemplary panels (202, 204, 302)) are made from are not affected by corrosion. Third, the condensed water is less likely to make contact with the roof sheathing (304) and other wood components of the roof structure. This preserves the life expectancy of the building's entire structure.

The condensed water ridges (216) extend longitudinally from the rear section (118) to the front section (116) of their respective exemplary panels (202, 204, 302). However, this is mainly for exemplary purposes, and the ridges (216) are not limited to the longitudinal length displayed in the sub-figure. In other embodiments, they can be shorter in length; however, this will compromise the water drainage from the lower surface (214) of the roof panel (i.e., the three exemplary panels (202, 204, 302)) because the condensed water will end up draining on the roof sheathing (304) and compromise the structural integrity of a building.

The weep hole (212) is considered 'angled' because it is located at the center of the diagonal portion (134) of the tongue (114). Apart from the obvious benefit of improved water drainage, the angled weep hole (212) provides improved wind resistance, though in a different way from the two-way interlocking aspect. Because the angled weep hole (212) is positioned downward, the wind is less likely to push water back through the weep hole (212) into the front interior space (308).

It should be noted that the size and positioning of the angled weep hole (212) in the figure are exemplary and are not limited to such a size or positioning in other alternative embodiments. In some embodiments, the weep hole (212) may be larger or smaller. In other embodiments, the weep hole (212) may be placed elsewhere on the roof panel (i.e., the three exemplary panels (202, 204, 302)). For example, the weep hole (212) may be placed on the face on the front section (116) of the panel (i.e., the three exemplary panels (202, 204, 302)). While this particular embodiment still provides good water drainage (from condensation or leakage), the wind may push the water back into the front interior space (308). In another example of alternative positioning, another embodiment may place the weep hole (212) between the diagonal portion (134) and insertable portion (136), which allows water (condensation or leakage) to drain faster onto the upper surface (106) of a vertically adjacent panel (202, 204) below. However, the wind may also push water on this upper surface (106) back into the adjacent weep hole (212).

In addition to the means of improved water drainage, the figure also exemplifies the vertical interlocking mechanism for the three exemplary roof panels (202, 204, 302). Combined with the horizontal interlocking mechanism (shown in the next figure), there is now improved resistance against the wind and increased security of the roof panel during panel installation.

The means for securing the insertable portion (136) of the bottom interlocking member (114) to the upper interlocking opening (122) may vary depending on the embodiment. In one such embodiment, the insertable portion (136) has an additional protrusion and the upper interlocking opening (122) may be modified with an additional slot to accommodate this protrusion. In other embodiments, various fasteners like nails, additional screws (306), snap-fit mechanisms, adhesives, magnets, or any other fasteners may be used to secure one panel (202, 204, 302) to another.

Three exemplary panels (202, 204, 302) are shown in this sub-figure; however, this is for exemplary purposes. It is obvious to those skilled in the art that there will be more panels covering the pitch of a roof sheathing (304), although that number (above three) will vary depending on the embodiment. In other embodiments, the roof may use fewer panels like only a first or second panel (202, 204). This may be possible thanks to the potentially large size of the panels (i.e., the three exemplary panels (202, 204, 302)) after injection molding with PVC. Ultimately, the number of roof panels installed on roof sheathing (304) will depend on the sheathing's (304) length and pitch.

It is obvious to those skilled in the art that the bottom faces of the upper interlocking member (120) and the nail flanges (124) are flat need to be flat so that they are flush with the roof sheathing (304). In another embodiment, the upper interlocking member (120) and the nail flanges (124) have rounded surfaces, though this may affect their installation on the roof sheathing (304).

Sub-figure (b) illustrates a cross-section view of a general roof panel (100), demonstrating the installation of a screw (306) into the roof sheathing (304). A screw (306) starts at an initial position (310) above the nail flange (124) of a roof panel (100); the initial position (310) is marked along the top surface of the screw (306) head. The screw (306) is installed in a downward direction (312) toward the nail flange (124). The screw (306) is inserted into the screw boss (126) of a nail flange (124), piercing the roof sheathing (304) with the final position (314) of the screw (306). The sub-figure also shows a close-up view of a roof panel's (100) angled weep hole (212) on the diagonal portion (134) of the tongue (114).

Thanks to the screw flange (124) and screw boss (126), installing the roof panel (100) on the roof sheathing (304) is quicker and more secure. The screw flange (124) holds and secures the screw (306) in place, so there is less of a chance for it to be displaced. It also requires less time to screw the roof panel (100) onto the roof sheathing (304) since the screw boss (126) acts as a sort of guide for inserting the screw (306). In a way, it saves time because the user does not have to be precise in positioning a screw (306) for securely installing the panel (100) onto the roof sheathing (304). In a sense, installing the roof panel (100) with the screw flange (124) and boss (126) is easier. The roof panel (100) also looks more aesthetically pleasing since the screw flange (124) and screw (306) are hidden from sight.

As the screw (306) is protected within the screw boss (126) of the screw flange (124), it is relatively protected from condensation and moisture forming on the lower surface (216) of the panel (100). As a result, the service life of the entire building is extended.

The screw (306) shown in the figure is the fastening method for the preferred embodiment; however, the screw (306) is exemplary and is not limited to this type or size. In some embodiments, the screw (306) can vary in type to include flathead, flange head, slotted head, pan head, etc. In other embodiments, the length of the screw (306) and diameter of the screw's (306) head can be large or small. In even more alternative embodiments, other fastening methods like nails, snap-fit mechanisms, glue, or any other suitable method may be used to secure a roof panel (100) onto the roof sheathing (304).

The screw boss (126) in this sub-figure is designed to match the shape and size of the screw (306). This is mainly for illustrative purposes, and, therefore, the screw boss (126) is not limited to the shape and size shown in the sub-figure. Different embodiments may have different screw boss (126) shapes and sizes to fit different types of screws (306), nails, or other suitable fasteners.

The shape of the tongue (114) and the sizes of its portions (134, 136) are mainly for illustrative purposes and are not limited to what is shown in the figure. For example, the insertable portion (136) and the diagonal portion (134) may have variable lengths depending on the embodiment. The shape may vary depending on the embodiment as well. For example, the tongue (114) may have no diagonal portion (134), so the tongue (114) would have in the shape of a capital 'L'. Additionally, the tongue (114) may take on a circular hook shape, triangular shape, or any other suitable shape. However, the upper interlocking member (120) and its opening (122) would need to be modified accordingly to fit with the modified tongue (114).

It should be noted that the thicknesses of the roof panels' (100, 202, 204, 302) shown in this figure are mainly for illustrative purposes and are not limited to the thicknesses shown in the sub-figure. The roof panel (100) may be thinner or thicker depending on the embodiment. Such modification in thickness would depend on the injection molding process or even the material used for manufacturing the roof panels (100).

Figure 4:
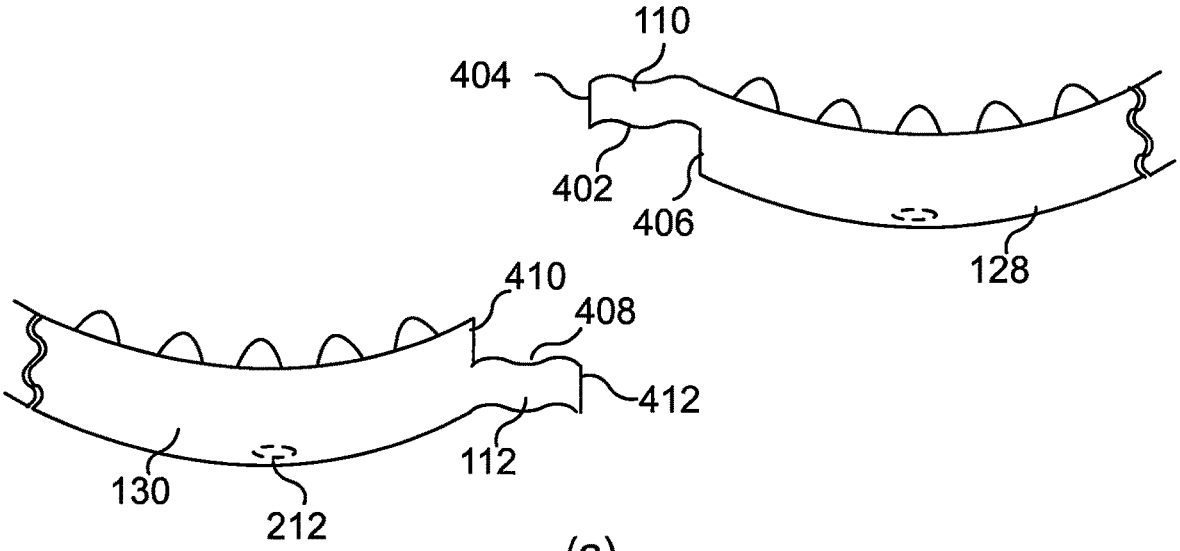
FIG. 4 illustrates front views of the horizontal interlocking mechanism (overlocking and underlocking) of the first and last watercourses of the roof panel in the present disclosure.
Figure 4:
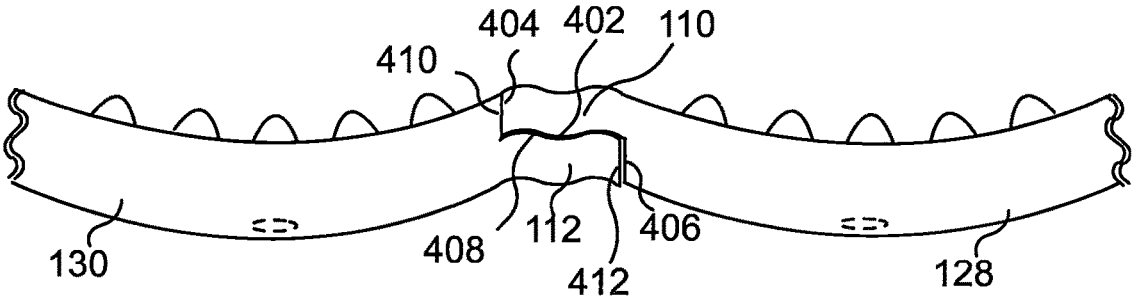

FIG. 4 illustrates front views of the horizontal interlocking mechanism of the first and last watercourses of the roof panel in the present disclosure. All descriptions of the first and last watercourses (128, 130), the overlock (110), and the underlock (112) from previous figures also apply here. Sub-figure (a) illustrates a front view of the first and last watercourses (128, 130) with their respective lateral interlocking members (110, 112) separated apart from one another. A first watercourse (128) of one panel is shown on the upper right with an overlock (110). Viewing the front of the first watercourse (128), the overlock (110) has a lateral overlock edge (404) on its left side with a perpendicular lower overlock surface (402). A first lateral water course edge (406) is located at the left edge of the first watercourse (128).

A last watercourse (130) of another panel is shown on the lower left with an underlock (112). Viewing the front of the last watercourse (130), the underlock (112) has a lateral underlock edge (412) on its right side with a perpendicular upper underlock surface (408). A second lateral water course edge (410) is located at the right edge of the last watercourse (130).

Sub-figure (b) illustrates a front view of the first and last watercourses (128, 130) with their respective lateral interlocking members (110, 112) joined together with the horizontal interlocking mechanism. The overlock (110) next to the first watercourse (128) of one panel is placed on top of the underlock (112) next to the last watercourse (130) of another panel. Here, the lateral overlock edge (404) of the first watercourse (128) lines up and connects with the second lateral watercourse edge (410) of the last watercourse (130). The lower overlock surface (402) of the overlock (110) lines up and connects with the upper underlock surface (408) of the underlock (112). The first lateral watercourse edge (406) of the first watercourse (128) lines up and connects with the lateral underlock edge (412) of the last watercourse (130).

The horizontal interlocking mechanism works together with the vertical interlocking mechanism to increase its security on the building and to increase resistance against wind. Since the two interlocking methods are present, the chances of the panel being blown away by the wind are minimized. The two-way interlocking also works with the nail flange to provide increased security for the panel's installation on the building. One minor benefit of the horizontal interlocking mechanism is an improved aesthetic, as the two watercourses (128, 130) are connected together seamlessly without any gaps.

It should be noted that the positioning of the overlock (110) next to the first watercourse (128) and the underlock (112) next to the last watercourse (130) is mainly exemplary. In an alternative embodiment, the placement of the overlock (110) and underlock (112) can be switched around so that the overlock (110) is next to the first watercourse (128) and the underlock (112) is next to the last watercourse (130). In other alternative embodiments, the overlock (110) and underlock (112) may both line up with the bottom or top of the first and last watercourses (128, 130); however, this would likely remove the horizontal interlocking mechanism or affect how the panels line up with one another.

Like with vertical interlocking, there can be various means and fasteners of securing one panel to another with the horizontal interlocking mechanism. In one such embodiment, the lateral interlocking mechanisms (110, 112) and their associated edges (402, 404, 406, 408, 410, 412) may have small protrusions and grooves to lock the lateral interlocking mechanisms (110, 112) in place. A snap-fit mechanism may be used in such an embodiment to ensure the connection between the two watercourses (128, 130) and their lateral interlocking members (110, 112). In other embodiments, various fasteners like magnets, additional nails or screws, glue, or any other fasteners may be used to laterally secure one panel to another.

The lateral overlock and underlock edges (404, 412) and watercourse edges (406, 410) are shown as a straight vertical line when viewing the front view. However, this is mainly for exemplary purposes and could be slanted at any angle and direction depending on the embodiment. For example, in one alternate embodiment, both the second lateral watercourse edge (410) of one panel and the lateral overlock edge (404) of another panel may be angled 45 degrees to the left. It should be noted that the angle of the watercourse edges (406, 410) should be the same as a lateral overlock and underlock edges (404, 412) for the horizontal interlocking mechanism to seamlessly connect the two panels without any gaps.

In another exemplary embodiment, the first lateral watercourse edge (406) and the lateral underlock edge (412) are slanted 25 degrees to the right. However, this may affect the shape of the tongue, particularly at its lateral ends.

Figure 5:
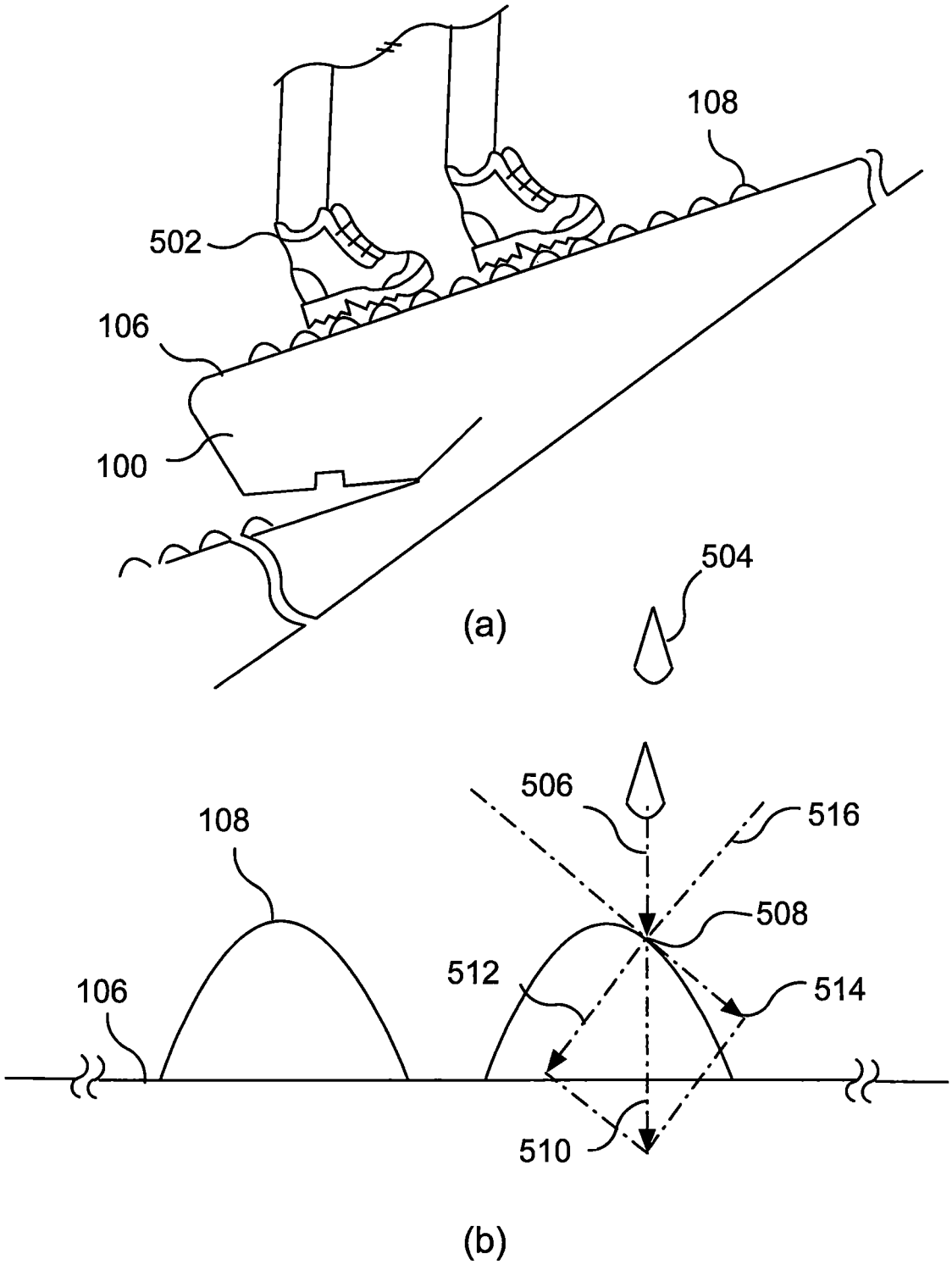
FIG. 5 illustrates the anti-slip and noise reduction applications of the non-smooth surface texture of the roof panel in the present disclosure.

FIG. 5 illustrates the anti-slip and noise dampening applications of the non-smooth surface texture of the roof panel in the present disclosure. Sub-figure (a) illustrates a side view of the pitched roof panel (100) and the non-slip application of the upper surface texture (108). A person, specifically a worker, is wearing shoes (502) and situated on top of a roof panel (100). The worker's feet (502) are situated on the non-smooth texture (108) on the upper surface (106) of the panel (100).

Traditionally, roof panels (100) have a smooth upper surface (106), which provides little friction. Water on the upper surface (106) further reduces this friction, making the roof panel (100) slippery and causing more accidents from slips and falls. As a result, the feet (502) of a worker can easily slip and cause injury to the worker. Thanks to the studs (108) provided by the non-smooth texture (108), there is increased friction that reduces the likeliness of slips and falls. In this case, a worker can safely work while keeping their feet (502) on top of the panel (100) for a longer period of time.

In addition to the reduced risk of slips on the upper surface (106) of the panel (100), installation speed can be faster regardless of weather conditions because a worker's feet (502) can stand on the non-smooth texture (108) on the upper surface (106) to maintain balance while installing additional roof panels (100).

The shoes (502) in the sub-figure are illustrated as work boots since construction workers are the ones that most commonly go up on the roof. However, this is mainly for illustration purposes and is not limited to such footwear. Different types of footwear, such as sneakers, rain boots, or any appropriate footwear can be used to similar effect on the roof panel (100) depending on the embodiment.

In an alternative embodiment, the studs (108) may be replaced with an elastomeric, mesh, or fibrous coating to act as the upper surface texture (108). Such materials are also suitable for preventing slips on the roof panel (100). However, this will likely affect the manufacturing speed of the roof panel (100), since this layer has to be added on separately from the injection molding. Alternative materials for the non-smooth texture (108) may also affect the speed of panel installation on the roof, particularly if the material is difficult to cut through.

Sub-figure (b) illustrates the noise dampening applications of the non-smooth texture (108) on the upper surface (106) of a panel. When it is raining, falling rain droplets (504) descend in a vertical direction (506) onto the panel. The rain droplets (504) eventually make contact with the studs (108) at the point of impact (508), shown on the top right of the stud (108) in the sub-figure. Normally, each rain droplet (504) at the point of impact (508) exerts a downward initial force, or F0 (510), on the upper surface (106)—this makes a loud noise that can be heard by people inside a building. Additionally, the rain droplets (504) normally bounce or deflect in a normal impacting surface direction (516). With the studs (108) on the upper surface (106), F0 (510) is split into two weaker component forces: a remaining force (512) or F1 that does make noise; a reduced force (514) or F2 that does make noise.

The rain droplets (504) can still hit the upper surface (106) directly, but because the studs (108) are prevalent throughout the upper surface (106), not as many rain droplets (504) will hit the smooth portions of the upper surface (106). So, the accumulated F0 (510) from all the rain droplets (504) hitting the upper surface (106) of the panel will not be as high. F0 (510) from all rain droplets (504) will be reduced to multiple component forces (512, 514), with only half of those making actual noise and causing fewer vibrations, leading to reduced noise in the building.

The vertical direction (506) of the rain droplets (504) is for reference purposes only. In other embodiments, the rain droplets could descend diagonally to various degrees, as other factors like wind, gravity, and the rotation of the earth may affect the direction of falling rain droplets (504).

It should be noted that the forces (510, 512, 514) are not of a fixed value and can vary as rain droplets (504) hit the upper surface (106) at multiple points of impact (508). This will depend on certain facts like the size of the studs (108), the direction and velocity of falling rain droplets (504), the intensity of rainfall, mass or rain per second, duration, size of the droplets (504), etc.

The directions of the forces (510, 512, 514) and the normal impacting surface direction (516) shown in the sub-figure are for illustrative purposes only, so the forces (510, 512, 514) can travel in other directions in other embodiments. Likewise, the normal impacting surface direction (516) can be shown in any other direction. However, the direction of the initial force, F0 (510), would be dependent on the direction that the rain droplets (504) fall. The direction of F1 (512) and F2 (514) would also be dependent on the direction of the rain droplets (504), as well as the point of impact (508).

The size and shape of the studs (108) are shown as a constant size. However, this is primarily for illustrative purposes and is not limited to such. The studs (108) can be larger or smaller depending on the embodiment. The studs (108) can also be a different shape in other embodiments as mentioned earlier. It should be noted that modification to the size and shape could affect both the friction of the surface texture (108) and how much noise is muffled. In the latter case, changing the shape and size of the studs (108) could affect F1 (512) and F2 (514) upon the point of impact (508). The normal impacting surface direction (516) may also be modified as a result of changing the stud size and shape.

The invention claimed is:

1. A roof panel having a lower surface and an upper surface, the roof panel comprising:

a watercourse having a front section and rear section; wherein the watercourse is sloped along a length of the roof panel so that the front section is at a lower elevation than the rear section relative to the upper surface of the roof panel;

an L-shaped tongue at the front section of the watercourse having a vertical portion, a horizontal portion, and an angled diagonal portion; wherein the L-shaped tongue laterally has a center part and a peripheral part;

a condensed water ridge under and extending along the lower surface of the roof panel; wherein the condensed water ridge is configured to guide condensed water flowing from the rear section to the front section and into the L-shaped tongue; wherein the L-shaped tongue is curved from the peripheral part toward the center part, forming the center part as a lowest elevation point among the peripheral and center parts, enabling the condensed water to collect;

a weep hole at the center part of the L-shaped tongue and on the angled diagonal portion configured to drain the condensed water out of the front section of the watercourse of the roof panel.

2. The roof panel of claim 1, wherein the roof panel is manufactured via an injection molding process with an injection moldable material.

3. The roof panel of claim 2, wherein the injection moldable material comprises PVC (polyvinyl chloride).

4. The roof panel of claim 1, wherein the upper surface of the roof panel has a non-smoothed texture to provide increased friction and reduced noise.

5. The roof panel of claim 4, wherein the non-smoothed texture includes a stud, a bump, a cone, an elastomeric material, a mesh, or a fibrous coasting.

6. The roof panel of claim 1, further comprising a plurality of interlocking members configured for a horizontal interlocking and a vertical interlocking with adjacent roof panels.

7. The roof panel of claim 6, wherein the plurality of interlocking members comprises a bottom interlocking member with a tongue and an upper interlocking member with a matching opening for a vertical interlocking; wherein the tongue of the bottom interlocking member of the roof panel can securely engage a matching opening of an upper interlocking member of an adjacent roof panel.

8. The roof panel of claim 7, further comprising a left overlock part and a right underlock part; wherein the left overlock part of the roof panel matches with a right underlock part of an adjacent roof panel and the right underlock part of the roof panel matches with a left overlock part of another an adjacent roof panel.

9. The roof panel of claim 1, wherein the watercourse further comprises a plurality of watercourses and an arch between every two adjacent watercourses of the plurality of watercourses.

10. The roof panel of claim 9, wherein the plurality of watercourses is five; wherein each of the plurality of watercourses is corrugated and curved forming a U shape variously from the front section to rear section; wherein each of the plurality of watercourses is less curved at the rear section than the front section.

11. The roof panel of claim 1, wherein the roof panel is configured to be mounted onto a roof with flanges for screws or nails that are covered under another roof panel.

12. The roof panel of claim 11, wherein each of the flanges has a shape of a half-circle, a square, a triangle, or any other shape.

13. The roof panel of claim 1, wherein the front section of the watercourse of the roof panel has a shape of a square, a triangle, a sawtooth, or any other shape.

14. The roof panel of claim 1, wherein the watercourse comprises a flat portion at the rear section.

15. A method to protect a roof, the method comprising:

mounting a roof panel onto a roof of a building, wherein the roof panel comprises a watercourse with a front section and a rear section; wherein the watercourse is sloped along a length of the roof panel so that the front section is at a lower elevation than the rear section relative to the upper surface of the roof panel;

providing an L-shaped tongue at the front section of the watercourse having a vertical portion, a horizontal portion, and an angled diagonal portion; wherein the tongue laterally has a center part and a peripheral part;

providing a condensed water ridge under and extending along the lower surface of the roof panel; wherein the condensed water ridge is configured to guide condensed water flowing from the rear section to the front section and into the L-shaped tongue; wherein the L-shaped tongue is curved from the peripheral part toward the center part, forming the center part as a lowest elevation point among the peripheral and center parts, enabling the condensed water to collect;

providing a weep hole at the center part of the L-shaped tongue on the angled diagonal portion configured to drain the condensed water out of the front section of the watercourse of the roof panel.

16. The method of claim 15, further comprising forming the roof panel via an injection molding process with an injection moldable material comprising PVC (polyvinyl chloride).

17. The method of claim 15, further comprising implementing a non-smoothed texture to the upper surface of the roof panel for increased friction and reduced noise; wherein the non-smoothed texture includes a stud, a bump, a cone, an elastomeric material, a mesh, or a fibrous coasting.

18. The method of claim 15, further comprising interlocking the roof panel with adjacent roof panels in a horizontal direction and a vertical direction; wherein the roof panel comprises a bottom interlocking member with a tongue and an upper interlocking member with a matching opening for interlocking in the vertical direction; wherein the tongue of the bottom interlocking member of the roof panel can securely engage a matching opening of an upper interlocking member of an adjacent roof panel; wherein the roof panel comprises a left overlock part and a right underlock part; wherein the left overlock part of the roof panel matches with a right underlock part of an adjacent roof panel and the right underlock part of the roof panel matches with a left overlock part of another adjacent roof panel.

19. The method of claim 15, wherein the watercourse further comprises a plurality of watercourses and an arch between every two adjacent watercourses of the plurality of watercourses; wherein the plurality of watercourses is five; wherein each of the plurality of watercourses is corrugated and curved forming a U shape variously from the front section to rear section; wherein each of the plurality of watercourses is less curved at the rear section than the front section; wherein the front section of each of the plurality of watercourses of the roof panel has a shape of a square, a triangle, a sawtooth, or any other shape.

20. The method of claim 15, further comprising mounting the roof panel onto a roof with flanges for screws or nails that are covered under another roof panel; wherein each of the flanges has a shape of a half-circle, a square, a triangle, or any other shape; wherein the watercourse comprises a flat portion at the rear section.

* * * * *